US007173203B2

(12) United States Patent
Ma

(10) Patent No.: US 7,173,203 B2
(45) Date of Patent: Feb. 6, 2007

(54) INTEGRATED MICROSPRINGS FOR SPEED SWITCHES

(75) Inventor: Qing Ma, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/012,520

(22) Filed: Dec. 15, 2004

(65) Prior Publication Data

US 2005/0103608 A1 May 19, 2005

Related U.S. Application Data

(62) Division of application No. 10/715,901, filed on Nov. 17, 2003, now Pat. No. 6,861,599, which is a division of application No. 10/113,718, filed on Apr. 1, 2002, now Pat. No. 6,753,747.

(51) Int. Cl.
*H01H 57/00* (2006.01)

(52) U.S. Cl. ..... 200/181; 335/78; 361/230; 438/48; 257/421

(58) Field of Classification Search ..... 200/181; 335/78, 80, 128; 361/230–235; 257/420–421, 257/414, 418; 438/48–52
See application file for complete search history.

(56) References Cited

U.S. PATENT DOCUMENTS

| | | | | |
|---|---|---|---|---|
| 5,690,498 | A * | 11/1997 | Sobhani | 439/22 |
| 6,046,659 | A * | 4/2000 | Loo et al. | 333/262 |
| 6,075,428 | A * | 6/2000 | Polese | 335/78 |
| 6,124,650 | A * | 9/2000 | Bishop et al. | 310/40 MM |
| 6,191,671 | B1 * | 2/2001 | Schlaak et al. | 335/78 |
| 6,566,617 | B1 * | 5/2003 | Suzuki et al. | 200/181 |
| 6,731,492 | B2 * | 5/2004 | Goodwin-Johansson | 361/233 |
| 6,903,637 | B2 * | 6/2005 | Miyazaki et al. | 335/78 |
| 2002/0050882 | A1 * | 5/2002 | Hyman et al. | 335/78 |

* cited by examiner

*Primary Examiner*—K. Lee
(74) *Attorney, Agent, or Firm*—Trop, Pruner & Hu, P.C.

(57) ABSTRACT

An integrated microspring switch may be provided for relatively high frequency switching applications. A spring arm may be formed over a microspring dimple, which may be hemispherical and hollow in one embodiment. When the spring arm contacts the dimple, the spring dimple may resiliently deflect away or collapse, increasing the contact area between the spring arm and the dimple.

10 Claims, 5 Drawing Sheets

INTEGRATED MICROSPRINGS FOR SPEED SWITCHES

This application is a divisional of prior application Ser. No. 10/715,901, filed on Nov. 17, 2003 now U.S. Pat. No. 6,861,599, which is a divisional of prior application Ser. No. 10/113,718, filed Apr. 1, 2002 now U.S. Pat. No. 6,753,747.

BACKGROUND

This invention relates generally to switches for high speed circuits such as radio frequency switches.

In switches that operate at high speed, it is important that the switch itself does not unduly degrade the signal being switched. Insertion loss is a measure of signal degradation caused by a switch. Insertion loss is dominated by the dimple contact resistance. Generally, a cantilevered switch arm includes a dimple or hemispherical portion near its free or moving end which contacts a contact pad on a fixed structure.

To reduce the resistance in contact, soft metals are used for the dimples and large contact forces are often necessary to increase real contact area. Soft metals and large contact forces result in faster contact wear. As the contact wears, the reliability of the switch may be adversely affected.

Thus, there is a need for better ways to make switches for high speed circuits.

DETAILED DESCRIPTION

Figure 1:
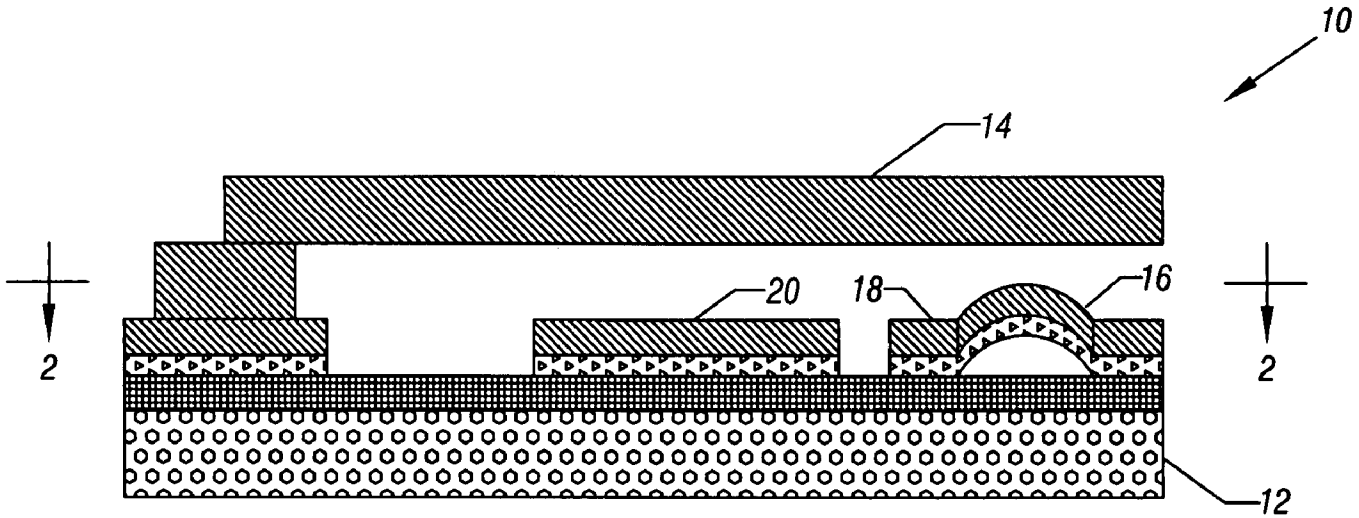
FIG. 1 is a greatly enlarged cross-sectional view of one embodiment of the present invention.

Referring to FIG. 1, an integrated microelectro-mechanical system (MEMS) switch 10 for a high speed circuit, such as a radio frequency circuit, includes a semiconductor structure 12 coupled to a contact arm 14. In one embodiment of the present invention, the contact arm 14 is a cantilevered contact arm. The free end of the contact arm 14 contacts a microspring dimple 16 positioned on the structure 12. The actuation or movement of the arm 14 may be under control of a plate 20 which applies an electrical force to the arm 14 to attract it towards the structure 12 in one embodiment of the present invention.

Figure 2:
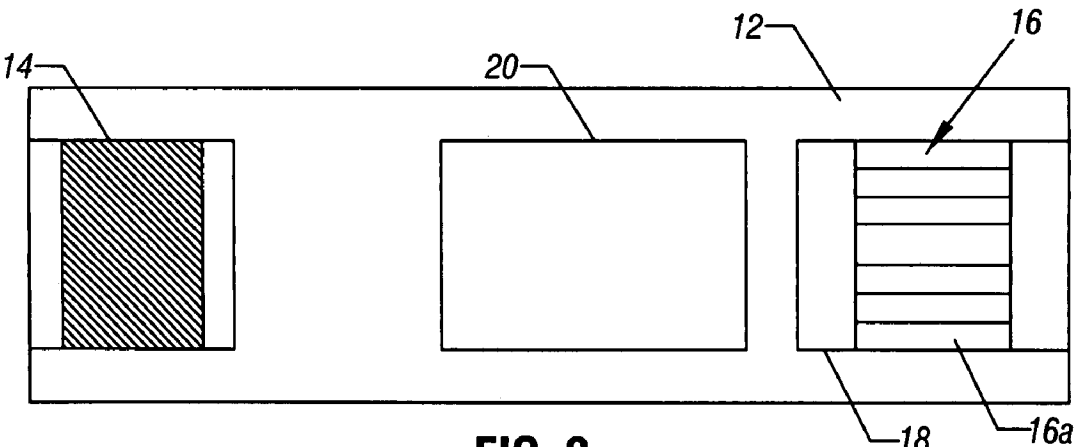
FIG. 2 is a cross-sectional view taken generally along the line of 2—2 in FIG. 1.

As shown in FIG. 2, the microspring dimple 16 may include a plurality of spaced hemispherical strips 16*a* which extend between contact areas 18 for electrical connection to the remainder of the controlled circuit. In some embodiments, the microspring dimple strips 16*a* may be made of relatively stiff material that is resilient so that it is possible to have a large contact area between the arm 14 and the dimple 16 without using particularly soft metals or large contact forces.

When the spring arm 14 is deflected by the plate 20 to contact the strips 16*a*, the strips 16*a* may deflect or collapse resiliently, increasing the contact area with the spring arm 14. Therefore, the microspring dimple 16 may achieve low contact resistance and superior contact reliability in some embodiments.

Figure 3:
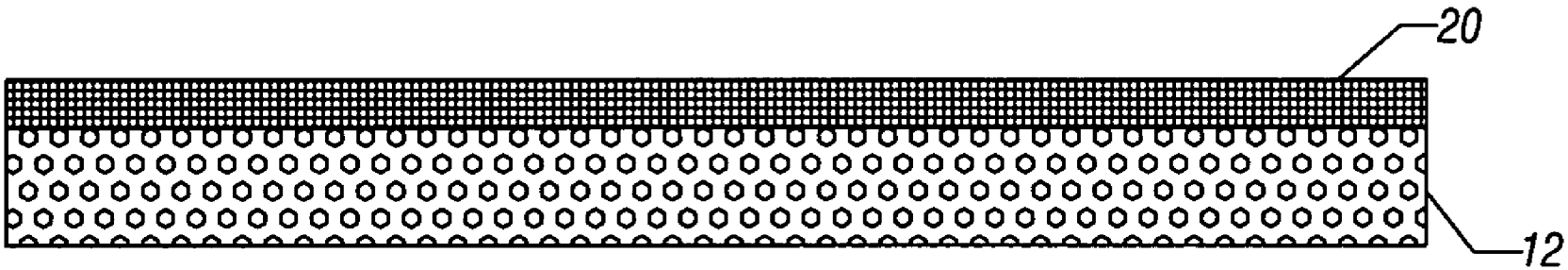
FIG. 3 is an enlarged cross-sectional view at an early stage of manufacturing for the structure shown in FIGS. 1 and 2 in accordance with one embodiment of the present invention.

In accordance with one embodiment of the present invention, the structure shown in FIGS. 1 and 2 may be manufactured from a semiconductor structure 12 having a dielectric layer 20 formed thereon as shown in FIG. 3. The dielectric layer 20 may be, for example, silicon nitride. The dielectric layer 20 isolates the conductive material utilized for the microspring dimple 16 from the semiconductor structure 12.

Figure 4:
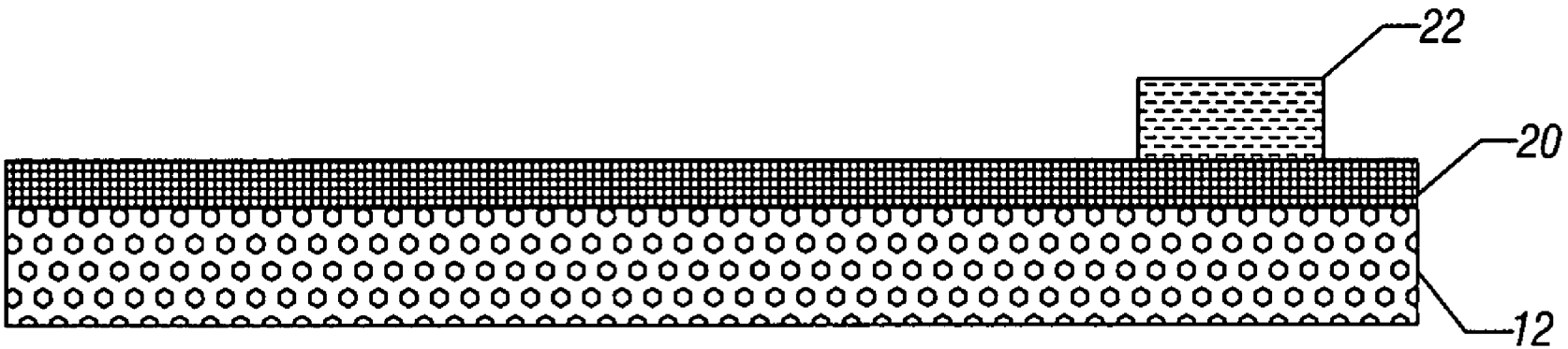
FIG. 4 is an enlarged cross-sectional view at a subsequent stage in accordance with one embodiment of the present invention.
Figure 5:
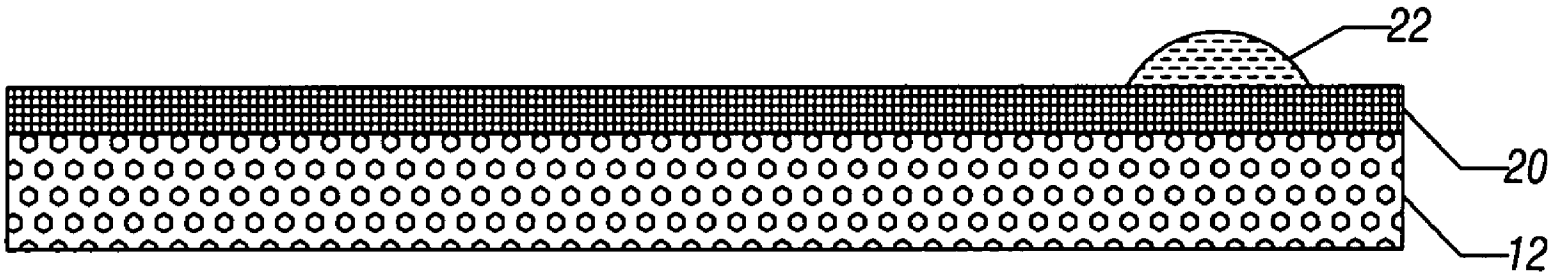
FIG. 5 is an enlarged cross-sectional view at a subsequent stage in accordance with one embodiment of the present invention.

Moving to FIG. 4, a reflow layer 22 may be deposited and patterned. The reflow layer may be made of polymeric materials, such as polyimide, resist, or flowable glasses, to mention a few examples. As shown in FIG. 5, the layer 22 may be reflowed at an elevated temperature to assume a hemispherical shape.

Figure 6:
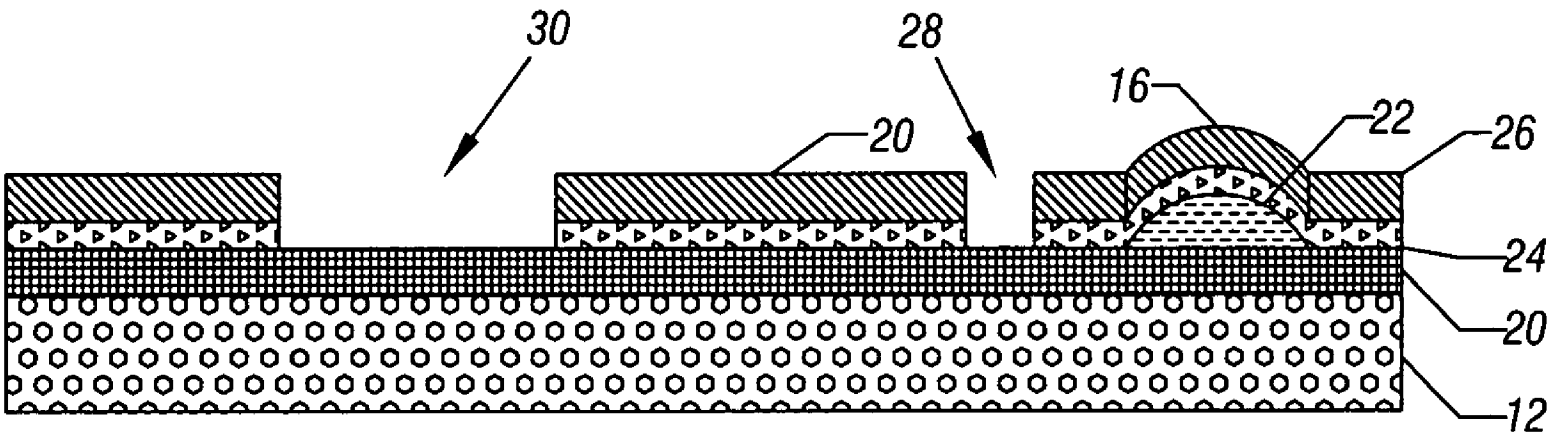
FIG. 6 is an enlarged cross-sectional view at a subsequent stage in accordance with one embodiment of the present invention.

Referring to FIG. 6, a conductive layer may be formed over the structure shown in FIG. 5. The conductive layer may be metal in one embodiment or may be a composite of two layers 24 and 26 in another embodiment. The top layer 26 may be optimized for contact resistance and the bottom layer 24 may be optimized for controlling spring compliance. Thus, the top layer 26 may be conductive and may be formed of a metal in one embodiment while the bottom layer 24 may be formed of a metal or a dielectric in some embodiments.

A plurality of openings 28 and 30 may be patterned in the layers 24 and 26 to ultimately form the actuator plate 20 and the microspring dimple 16. Because of the imposition of the reflowed layer 22, the microspring 16 takes on a hemispherical shape.

Figure 7:
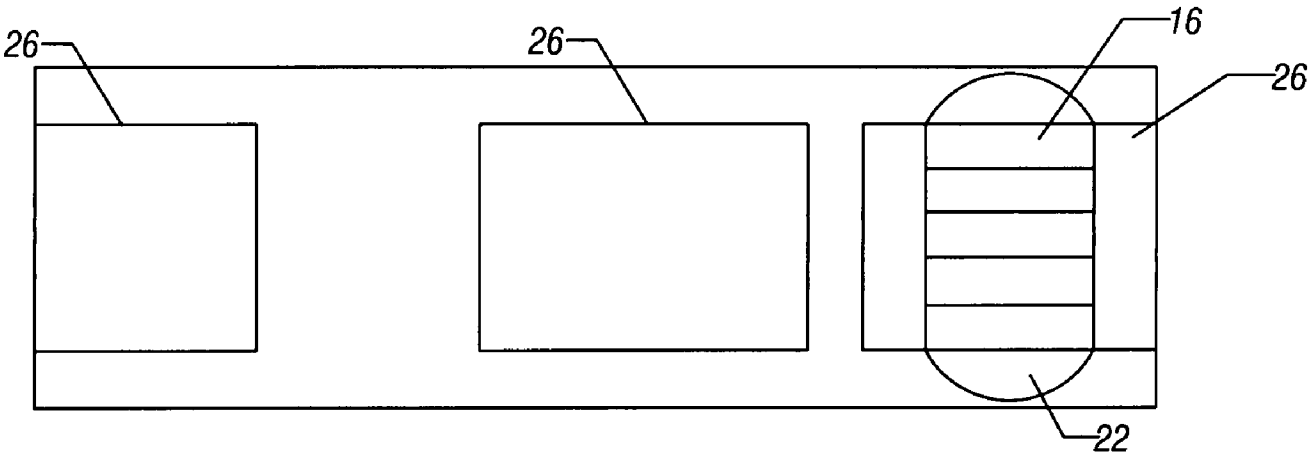
FIG. 7 is a top plan view of the structure shown in FIG. 6 in accordance with one embodiment of the present invention.

As shown in FIG. 7, a plurality of curved strips 16*a* may make up the microspring dimple 16 in one embodiment of the present invention. Each of the strips 16*a* may be formed integrally with surrounding contact areas 18 that may electrically couple other electrical components. Also formed as a result of the steps shown in FIG. 6, is the base 26 for the spring arm 14 and the actuator plate 20.

Figure 8:
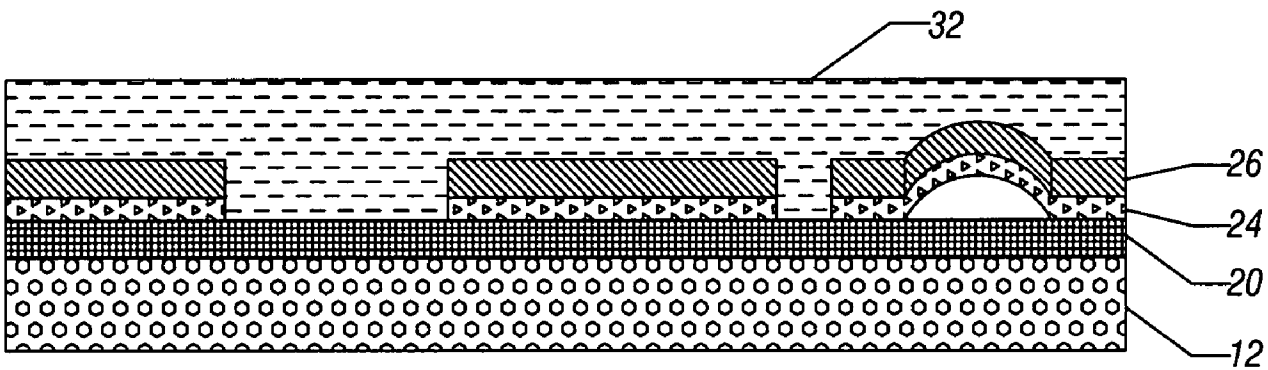
FIG. 8 is an enlarged cross-sectional view at a subsequent stage of manufacturing in accordance with one embodiment of the present invention.

As shown in FIG. 8, a release layer 32 may be deposited over the structure shown in FIG. 7 in one embodiment of present invention, and the resulting layer may be planarized. In one embodiment, the layer 32 may be formed of the same material as the layer 22. Planarization can be done in a variety of ways, including using reflow.

Figure 9:
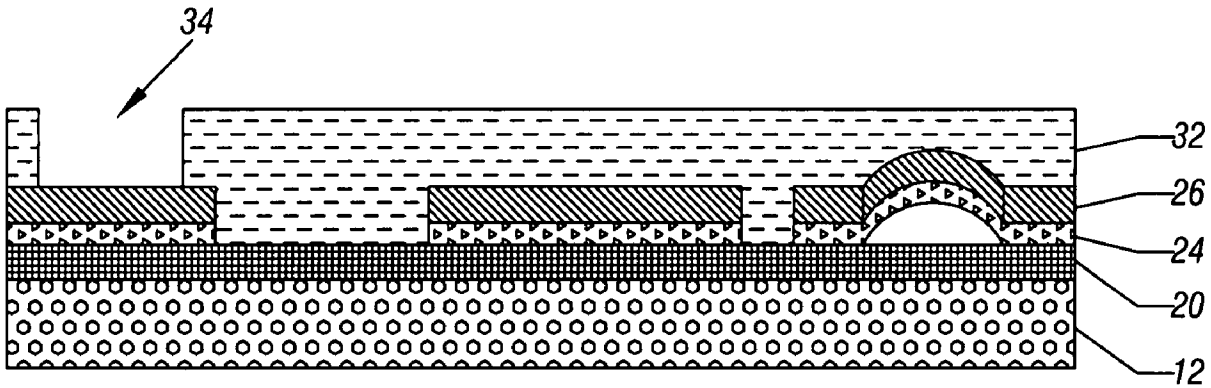
FIG. 9 is an enlarged cross-sectional view at a subsequent stage of manufacturing in accordance with one embodiment of the present invention.
Figure 10:
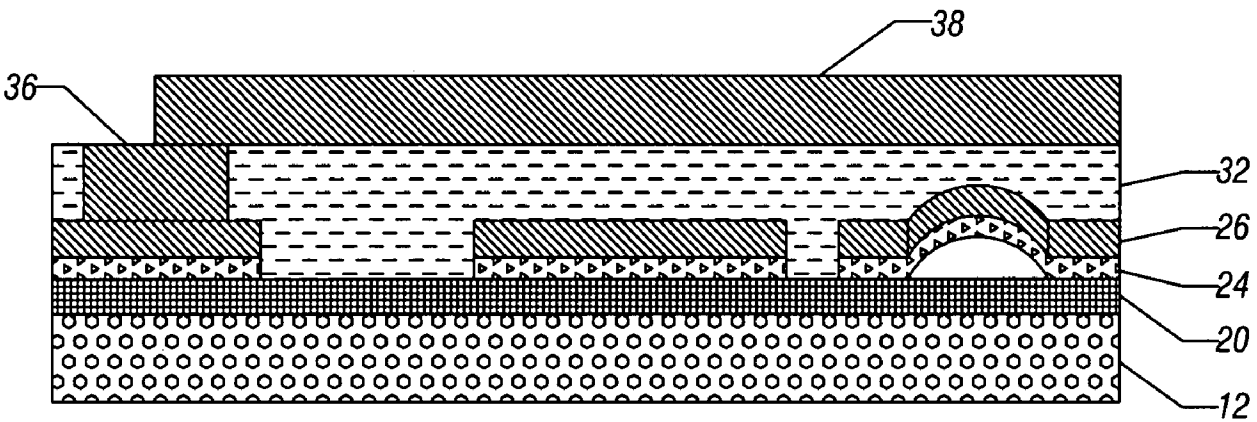
FIG. 10 is an enlarged cross-sectional view at a subsequent stage of manufacturing in accordance with one embodiment of the present invention.

As shown in FIG. 9, a hole 34 may be formed over the layer 26. As shown in FIG. 10, an anchor 36 may be deposited in the hole 34. The anchor 36 may be made of a conductive material such as metal. A layer 38 of the spring arm 14 may then be formed, for example, by depositing a resilient metal and patterning the deposited metal.

The release layer 32 is then removed, for example, by heating in accordance with one embodiment of the present invention, resulting in the structure shown in FIG. 1. The portion of the release layer 32 underneath the dimple 16, as well as the material between the spring arm 14 and the structure 12, is also removed. In some embodiments, the heated release material simply passes as a gas through the gaps between the spring arm strips 16*a*.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

forming a curved microspring, spaced over a semiconductor structure, having a convex upwardly facing surface and a closed, hollow interior space under said microspring; and forming a spring arm on said semiconductor structure over said microspring.

2. The method of claim 1 including forming a curved microspring by depositing a first material on said structure, covering said first material with a conductive second material and subsequently removing said first material.

3. The method of claim 2 including removing the first material by heating the first material.

4. The method of claim 1 including forming said microspring, an actuator for said spring arm, and at least a portion of said spring arm by forming a first layer on said semiconductor structure and patterning said first layer.

5. The method of claim 4 including covering said layer with a removable material and covering said removable material with a second layer.

6. The method of claim 5 including removing said removable material.

7. The method of claim 6 including heating said material to remove said material.

8. The method of claim 7 including removing the first material underneath the microspring and said removable material at the same time.

9. The method of claim 1 including forming said microspring of a plurality of strips.

10. The method of claim 9 including forming said strips under a free end of said spring arm.

* * * * *